United States Patent [19]

Delmer

[11] 4,325,298

[45] Apr. 20, 1982

[54] FRAME STRUCTURE FOR A PRESS ASSEMBLY

[75] Inventor: Philip T. Delmer, Shorewood, Wis.

[73] Assignee: Rexnord Inc., Milwaukee, Wis.

[21] Appl. No.: 218,583

[22] Filed: Dec. 19, 1980

Related U.S. Application Data

[63] Continuation-in-part of Ser. No. 49,030, Jun. 18, 1979, Pat. No. 4,240,342.

[51] Int. Cl.[3] ..... B30B 15/04

[52] U.S. Cl. ..... 100/214; 425/77

[58] Field of Search ..... 100/214, 53, 269 R; 72/455; 83/701; 425/77

[56] References Cited

U.S. PATENT DOCUMENTS

| | | | |
|---|---|---|---|
| 1,251,430 | 12/1917 | Sherman | 100/214 |
| 2,491,384 | 12/1949 | MacMillin | 100/214 |
| 2,837,944 | 6/1958 | Albers | 100/214 |
| 3,030,879 | 4/1962 | Lasko | 100/214 |
| 3,353,397 | 11/1967 | Hoffmann | 72/455 |

FOREIGN PATENT DOCUMENTS

| | | | |
|---|---|---|---|
| 2530325 | 1/1977 | Fed. Rep. of Germany | 100/214 |
| 449825 | 5/1975 | U.S.S.R. | 100/214 |

*Primary Examiner*—Billy J. Wilhite

*Attorney, Agent, or Firm*—Vance A. Smith; Aaron L. Hardt

[57] ABSTRACT

A press assembly having an improved frame including a crown, bed, cylinder, and ram assembly tied together by tie rods and compression members in which a platen assembly secured to the ram assembly guides directly on the inward facing surface portions of the tie rods. Associated compression members juxtaposed around the outward facing surface portions of the tie rods provide stability to the whole press assembly and form part of an enclosure about the press assembly. Washers having outwardly tapering transverse portions are mounted on each tie rod to prevent bending of the tie rods at their ends.

2 Claims, 15 Drawing Figures

FRAME STRUCTURE FOR A PRESS ASSEMBLY

CROSS-REFERENCES TO RELATED APPLICATIONS

This application is a continuation-in-part of U.S. patent application Ser. No. 049,030 filed June 18, 1979; now U.S. Pat. No. 4,240,342. U.S. Pat. Nos. 1,251,430; 2,491,384; and 3,030,879 were references cited against the parent application.

BACKGROUND OF THE INVENTION

1. Field of the Invention

The present invention is related to frame structures used in press assemblies and is particularly related to tie rod and compression member frame structures which when employed in the translation of high pressure results in ultra high pressure on the tooling apparatus.

2. Discussion of the Prior Art

Press assemblies using tie rods and compression members (generally known as prestressed tie rod press assemblies) are often employed in many press applications. In such assemblies, the compression members are preloaded to a high percentage of the rated capacity of the press, normally above 100 percent, so that, when the assembly is under load, both the stretch of the vertical members and cyclical fatigue are reduced, resulting in greater stability. Preloading of the assembly is generally accomplished by heating the tie rods through various means such as calrods. While the tie rods are heated and therefore expanded in length, the tie rod nuts are tightened. Upon cooling, the tie rod is preloaded in tension while the compression member is preloaded in compression.

Such characteristics can beneficially be employed in very high pressure applications such as, for example, the compacting of carbonaceous materials into extremely hard products, i.e. diamonds used in various industrial apparatus. Extremely high pressures with concomitant high temperatures introduced by passing an electric current through the material being compacted are necessary in the manufacture of diamonds, the pressures exceeding 1,000,000 p.s.i. Since normal steels used as tooling will fail under this load, it is necessary to use materials with an extremely high Young's Modulus, such as tungsten. Tungsten, like other materials with a high Young's Modulus, characteristically has a poor bending ability. At such high operating conditions, weaknesses in the tool structure due to material defects or fatigue become serious problems and, literally, explosions may occur under an improperly applied load. To protect operating personnel, the entire press assembly must be surrounded by an enclosure, generally fabricated from heavy gauge steel sheet or plates.

The configuration of the assembly affects the safety, accessibility, method of guiding the moving members, structural space requirements, and the total weight of the press structure. The weight requirements needed for high pressure applications obviously detrimentally affect the economics. With high pressure applications, it is additionally necessary to ensure that the moving press platen is precisely guided while it moves the high pressure tooling apparatus to a position where pressure will be applied by holding the tooling apparatus substantially on the central vertical axis of the press assembly. Upon application of pressure, it is important that reactionary loads from the press assembly are not transferred to the apparatus which would tend to induce a shift in position of the high pressure tooling apparatus, thereby resulting in transverse loads on the tooling apparatus and their possible premature failure.

It is, therefore, a paramount object of the present invention to provide for a press assembly, particularly effective in high pressure applications, having reduced weight and space requirements, while maintaining its high safety standards. Another, but equally important, object is to minimize the potential error of tooling apparatus location at the point of, but prior to, application of pressure by reducing the horizontal guiding span length. Still another, but equally important objective, is to maintain the horizontal span of the tooling apparatus working space, even while reducing the guide span of a press assembly which has tie rods and compression members. Still another additional objective is to reduce the relative square footage of safety shrouding, while maintaining or improving the quality of safety shrouding.

SUMMARY OF THE INVENTION

In accordance with one embodiment of the preferred invention, the force member and resistance members of a press assembly are tied together by a plurality of pretensioned tie rods and compression members, the former serving as guides for the moving platen or press member portion of the force member. The platen is located on the vertical central axis of the assembly and is guided by the inward surface portion of the tie rods.

The compression members, which have generally been employed as guides in the typical prior art press assemblies described hereinabove have, by virtue of this invention, the dual function of being a compression member and serving as part of the safety enclosure required by ultra high pressure assemblies. Provision of the pretensioned tie rods as guides and use of the compression members as shrouds minimizes space requirements and significantly reduces weight and costs.

Additional benefits resulting from the reduced distance between the tie rods and the moving elements of the press is the reduction of the guide span without reducing the free horizontal work space. Improved guiding accuracy is still another benefit.

As will be noted from the ensuring detailed descriptiominimize or offset bending of the tie rods due to deflection of the crown and bed under load.

Other advantages of the present invention will also be apparent to those skilled in the art in light of the following description and appended drawings.

DESCRIPTION OF THE PREFERRED EMBODIMENT

There are a variety of tie rod, compression member press assemblies in use today. For example, a type frequently employed in industry is designed with two box structure compression members, each encompassing a pair of tie rods. The compression members are positioned on opposite sides of the press assembly work area with the rectangular, planar surfaces providing surfaces upon which the platen guides.

Figure 1:
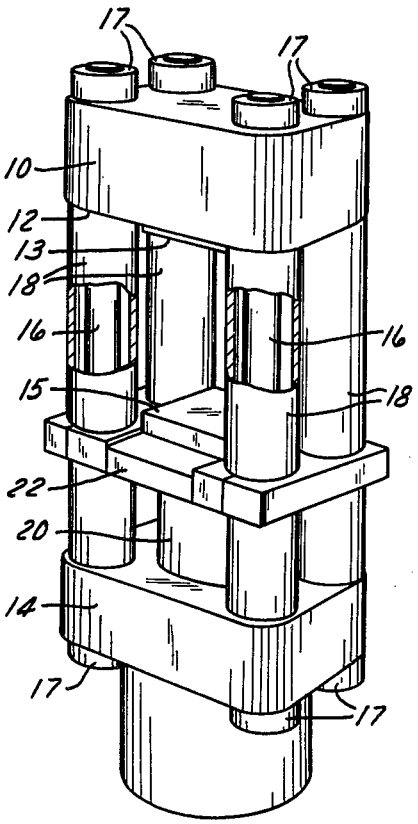
FIG. 1 PRIOR ART
FIG. 1 is a perspective of the frame structure of a typical prior art press assembly employing tie rods and compression members.

Another type of tie rod, compression member press assembly is illustrated by FIG. 1. In this type of press assembly, each tie rod has an "individual" compression member associated with it in the form of a sleeve. The present invention is considered a significant improvement over a press assembly employing the sleeve type compression member.

The press assembly depicted in FIG. 1 basically has a frame 10 comprised of a crown or upper resistance member 12, a bed or lower resistance member 14, a plurality of tie rods 16, and a plurality of cylindrically-shaped compression members 18, each in the form of a sleeve enclosing a tie rod 16. Extending from resistance member 14 is a single acting piston or ram 20 supporting a movable platen 22 guided by compression members 18. The tie rods function to tie the crown 12, bed 14 and, consequently, platen 22 together, but in a spaced relationship. Ram 20 is powered by an external power source (not shown) such as a hydraulic pump and accessories. Secured to crown 12 is a die 13 having a desired configuration (not shown) which complements die 15 mounted on platen 22. As is evident from FIG. 1, it is extremely desirable that platen 22 be precisely guided to ensure the mating of die 13 with die 15.

To prevent what is known in the press assembly art as "lift off", tie rods 16 are often prestressed. Lift off is caused by an elongation of the tie rods under increasing loads experienced in the press operation. The consequence of lift off is the separation of parts during a pressing cycle, which is particularly disastrous when die assemblies are employed. For example, the manufacture of diamonds, borozon, or other extremely hard materials requires the careful and sensitive mating of die assemblies under pressure. Prestressing is often accomplished by heating the tie rod when in position in the press structure and tightening the nut 17. The rod is prevented from returning to its original length by reason of load angle versus friction on the faces of crown 12 and bed 14 which abut nut 17. The compression members 18 permit preloading of frame 10, but also serve as guides for the platen 22, as illustrated.

Because of the extremely high pressures involved and growing awareness of the need for personal safety, it is now mandatory to enclose the entire press working area by heavy gauge steel covers. It should be understood from the drawing and considerations set forth above that the press assembly is heavy, occupies considerable space, and therefore requires a considerable amount of steel material to completely surround it.

Figure 2:
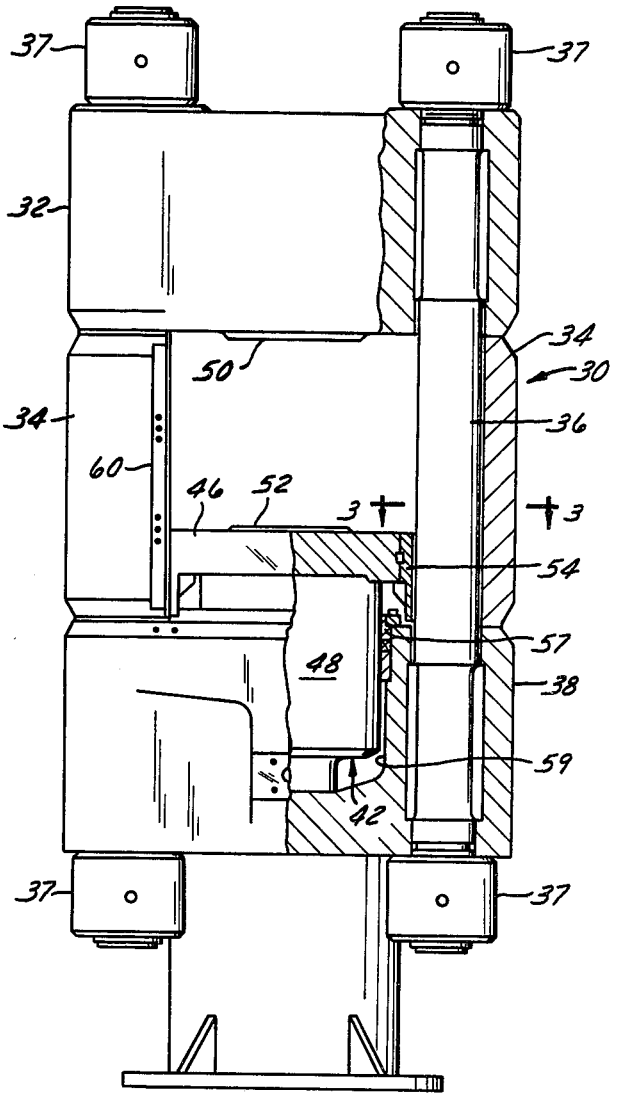
FIG. 2 is a front view of a press assembly partially in section, in accordance with the present invention.
Figure 3:
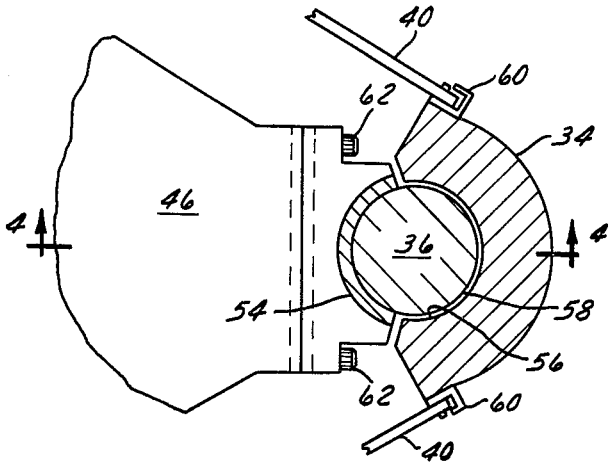
FIG. 3 is a plan sectional view taken along lines 3—3 of FIG. 2.

As shown in the several views of the drawings, and particularly in the front view, partially in section, of FIG. 2, the press 30 comprises a crown 32, compression members 34, tie rods 36, bed 38, and enclosure or shrouds 40 (seen only in FIG. 3). This press is designed primarily, but not exclusively, for use in high pressure applications. Thus, although three tie rods 36 are preferred, it is understood that the number of tie rods employed is not important for purposes of the invention. It should be evident, however, a smaller number of rods and associated structure simplifies the design and provides easier access to the internal working area of the press.

As in the prior art press assemblies, tie rods 36 tie together the crown or upper resistance member 32, the hydraulic cylinder assembly or force member 42 extending from cylinder 59 and the bed or lower resistance member 38. Secured in an appropriate manner between the crown 32 and bed 38 are compression members 34, each associated with a tie rod 36 in a manner to be described. When the prestressed tie rods 36 are tightened by rotation of nuts 37, the compression members 34 are squeezed between crown 32 and bed 38 and, therefore, are placed under compression. This provides good rigidity and parallelism to the overall press structure when a load is imposed. Additionally, fatigue caused by the cyclical nature and magnitude of the imposed loads on the press structure is reduced by this prestressing.

The hydraulic cylinder assembly 42 is depicted as a movable platen 46 moved by a single acting piston 48 mounted within cylinder 59 and driven by an appropriate hydraulic source (not shown) mounted on bed or lower resistance member 38. The hydraulic power source does not form part of this invention and may be of any type appropriate for a particular application. Platen 46 is positioned about the central vertical axis of the assembly between tie rods 36.

Figure 4:
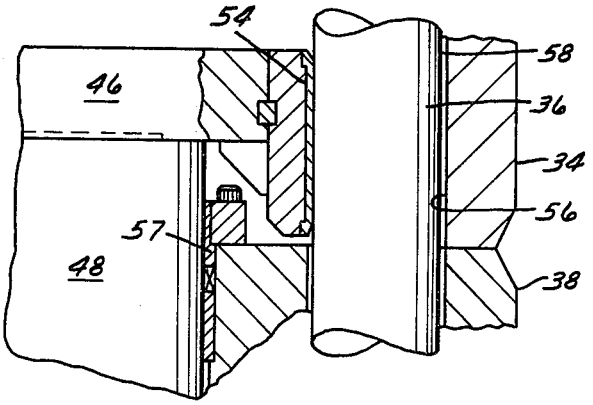
FIG. 4 is a sectional view taken along lines 4—4 of FIG. 3.

Secured to the bottom of crown 32 is a die 50 which mates with die 52 secured to platen 46. Platen 46 as shown guides along the inward facing surface portion of tie rod 36 through bushings 54. The arrangement of bushings 54 can best be seen in the sectional view of FIG. 4. In addition, bushings 57 and the associated packing arrangement for piston 48 can also be observed.

FIG. 3, a top sectional view taken along lines 3—3 of FIG. 2, is illustrative of the relationship of tie rods 36, compression members 34, and platen 46. As is clearly shown, compression member 34 is a section of a thick wall, half cylinder, with its inner surface 56 being positioned closely adjacent a portion of surface 58 of tie rod 36. The compression members 34 are spaced outside of tie rods 36 and abut the inward surfaces of crown 32 and bed 38. Shrouds 40 actually cover all three openings into the press, but the ends thereof are appropriately secured to channels 60 which are in turn fastened to compression members 34.

One of the beneficial aspects of the present invention should now be apparent. By employing the tie rods as guides, instead of using the compression members in that capacity as is practiced in the prior art, the compression members can be employed as part of the safety shrouds. Tie rod, sleeve-type compression member press assemblies of the prior art ordinarily required the shroud to encircle the entire assembly, because the platen guides directly on the compressive sleeve member. Reference should be made to FIG. 1, where it may be seen that the platen 22 guides on the entire circumference of the compression member. It is clearly evident that when shrouds are employed, they must be placed a distance beyond the compression members sufficiently large enough to permit clearance for the platen to guide on the member.

The present invention, however, eliminates this requirement, because the platen guides on the tie rods 36. Thus, shroud 40, as seen in FIG. 3, not only may be placed in closer proximity to the press assembly working area, but also employs the compression members as part of the shroud itself. Collectively this results in a desirable weight and cost reduction of the assembly.

Platen 46 guides directly on tie rods 36 through bushings 54 which may be adjusted through bolts 62. It is desirable that platen 46 guide on a significant portion of the circumference of the tie rod 36. Preferably, the arc extension about the circumference should be not less than 150° nor more than 180°. Too large an extension will interfere with the function of the compression member 34 which may extend slightly more than 180° around rod 36.

The geometry of platen 46 can also be partially observed in FIG. 3. Platen 46, for use in a three tie rod press assembly, is generally triangularly shaped in plan view with three corner extensions terminating in adjustable bushings 54. The shape of platen 46, however, is determined largely by the number of tie rods employed as guides. Thus, the shape has no bearing on the invention as described.

Figure 5:
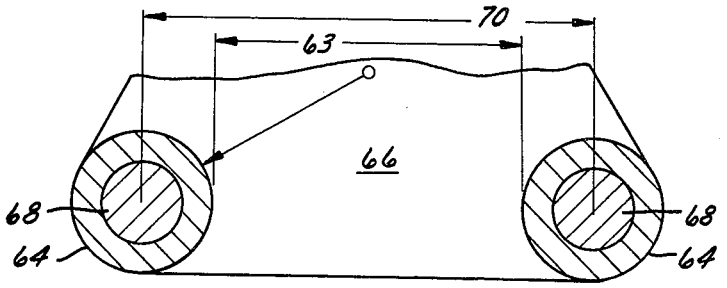
FIG. 5 PRIOR ART
FIG. 5 is a digrammatical plan view of a portion of a platen, adjacent tie rods, and compression members typified by a prior art press assembly.
Figure 6:
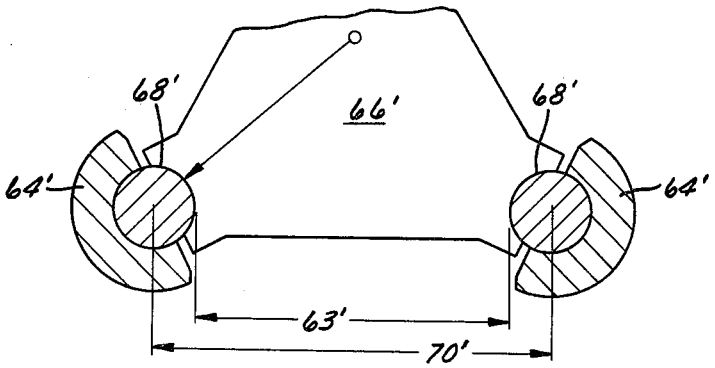
FIG. 6 is a diagrammatical plan view of a portion of a platen, adjacent tie rods, and compression members in accordance with the present invention.

A further advantage of the present invention is best described by using the schematics of FIGS. 5 and 6. FIG. 5 represents a plan sectional view of a prior art tie rod, compression sleeve press assembly in which three tie rods are used. For the sake of clarity, the various bushing members have been removed with only the platen, tie rod and compression members being illustrated. It should be noted that guiding takes place about the entire circumference of the sleeve type compression member. The guide span is denoted by line 70 which is the distance between the center line of adjacent compression members 64 along platen 66. Note that this is also the distance between center lines of tie rods 68. The free work area may alternatively be represented by the distance between the center of platen 66 and the nearest point on the surface of the compression member 64 or, as shown in FIG. 5, the distance between surfaces of adjacent compression members 64, i.e. by line 63.

Comparing lines 63 and 70 to corresponding lines 63' and 70' in FIG. 6, two facts are immediately evident. First line 63 is the same length as line 63'. On the other hand, line 70 is larger than line 70'. With regard to the latter, it is evident that the reason for the difference in lengths of lines 70, 70' is the replacement of compression member 64 in FIG. 5 by compression member 64' in FIG. 6 and using tie rod 68' as the guiding surface. The cylindrical sleeve compression member 64 becomes the half cylindrically shaped compression member 64' positioned outside, but closely adjacent to tie rod 68'. Since the centers of tie rods 68' are closer to one another, the guide span distance has been reduced, but at no sacrifice to work area which remains the same.

Figure 7:
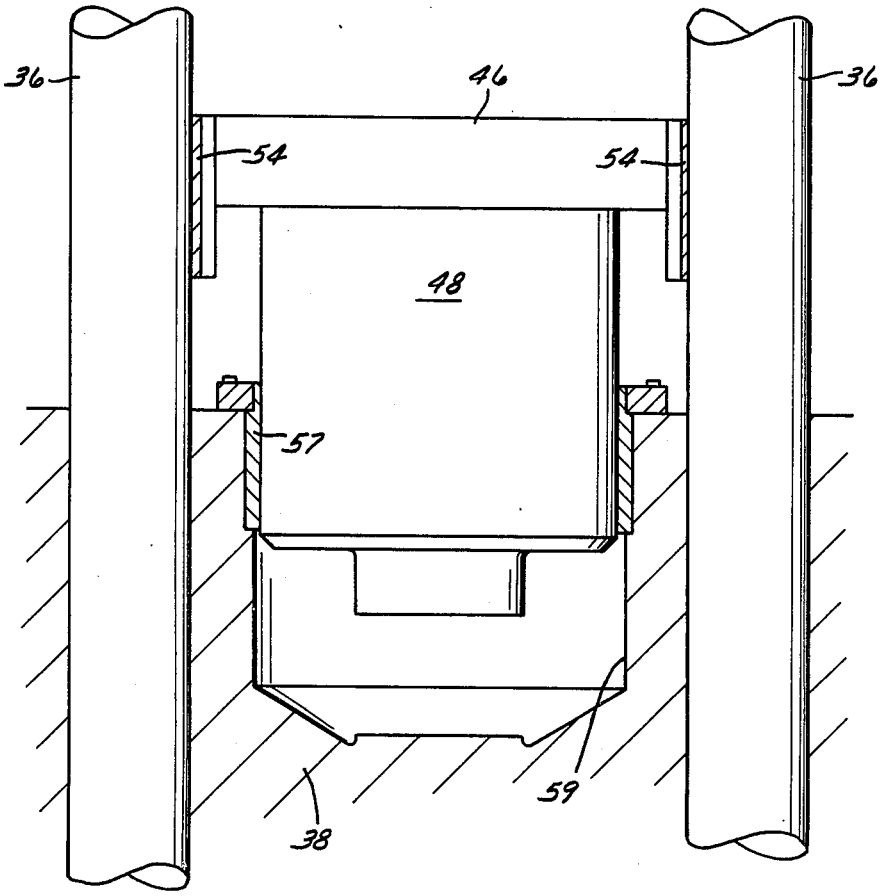
FIG. 7 is a schematic illustrating the improved vertical-horizontal relationship permitted by the inside guiding of the platen in accordance with the present invention.

Another attribute of reducing the span length is the contribution it provides to guiding accuracy. FIG. 7 schematically illustrates the improved vertical-horizontal relationship accomplished through the use of the present invention. Piston 48 guides along bushings 57 which are mounted to internal cylinder wall 59 in bed 38. Platen 46 guiding on the inside surface of rods 36 provides a better vertical to horizontal ratio than attained where guiding was done around the surface of a column displaced further from the center line of the press.

When a press assembly is in operation, some deflection always results in the crown as it resists further upward movement of the platen. The amount of deflection which occurs is directly proportional to both load and span, but inversely proportional to the vertical section or depth of the crown. Since deflection is particularly sensitive to changes in the span, i.e. proportional to its cube, reductions in the span as accomplished by the present invention (with the load remaining constant) allow the crown depth to be decreased if it is desired to keep deflection at the same level. Reducing the dimensions of the press crown obviously reduces the weight of the crown. Thus, reducing the span not only provides an increase in guiding accuracy, but also provides means by which significant weight reductions in the total assembly can be made without affecting its operation. The use of a half cylindrically shaped compression member with concomittant inside guiding on the tying members permits the desired reduction in span; therefore, a less massive press frame structure is needed, while simultaneously maintaining the identical deflection.

Figure 8A:
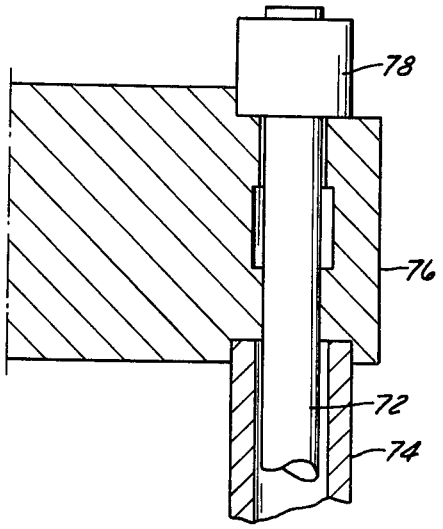
FIG. 8a PRIOR ART
FIGS. 8*a* and 8*b* depict a sectional view of a portion of a prior art tie rod and full sleeve press assembly.
Figure 8B:
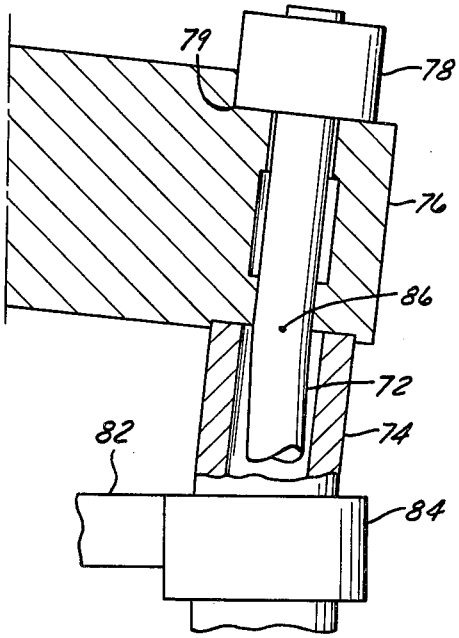
FIG. 8b PRIOR ART

FIG. 8*a* depicts in partial side section a view of a tie rod 72 which is enclosed by compression sleeve 74 and secured to crown 76 by nut 78. Crown 76 snugly abuts the circumference of rod 72 along its length near the base of crown 76. When the press assembly is under load as represented by FIG. 8*b*, crown 76 is deflected upward exerting an upward force on nut 78. The upward forces on nut 78 are greatest at the inward corner 79 and thus, cause rod 72 to bend as shown, although exaggerated for purposes of explanation. The fulcrum 80 of rod 72 is at the point where it is last abutted by crown 76. Compression member 74 which provides the guiding surface to plate 82 is also bent. The result can cause binding of the platen 82 and its guide 84 during movement or promote lateral deflection of the tooling assembly itself.

Figure 9A:
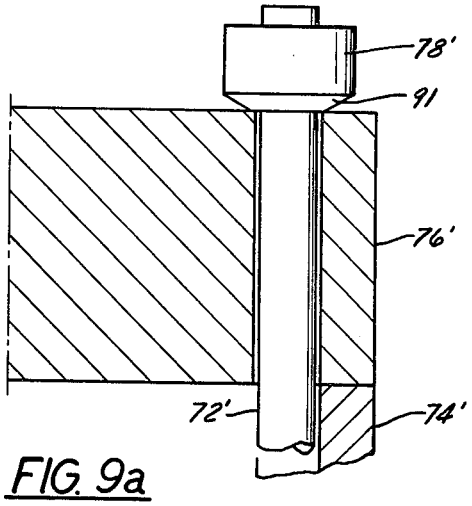
FIGS. 9*a* and 9*b* depict a sectional view of a portion of a tie rod and compression member in accordance with the present invention.
Figure 9C:
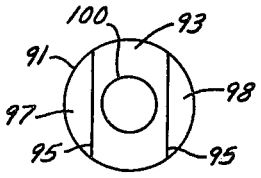
FIG. 9*c* is a bottom plan view of a washer advantageously employed in the present invention.
Figure 9B:
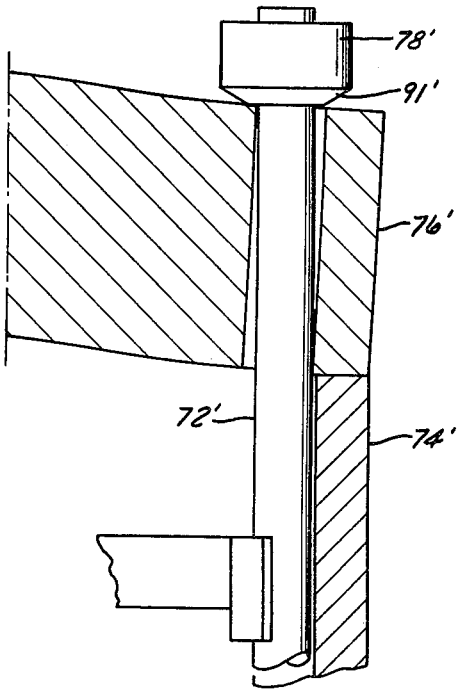

Advantageously, tie rod 72' can be provided a washer 91, as shown in FIGS. 9*a* and 9*b*. Washer 91 has a flat outward surface having a diameter greater than the diameter of the passage through crown 76' through which tie rod 72' extends and, preferably, at least as great as the diameter of nut 78'. The inward surface of washer 91, however, as best seen in FIG. 9*c*, has a flat central portion 93 having straight, parallel side lines 95 and outwardly tapering transverse portions 97, 98. Washer 91 has a centered bore 100 having a diameter substantially identical to the diameter of tie rod 72'. The width of flat central portion 93 is greater than the diameter of the passage through crown 76' so that the flat central portion 93 of the inward surface of washer 91 contacts and supports washer 91 on the outward surface of crown 76'.

By careful determination of the forces exerted on crown 76' by the tying members, compression members, platen and platen moving means, the preferred width of flat central portion 93 and taper of transverse portions 97, 98 can be determined for various press sizes. When the press assembly is under load, as represented by FIG. 9*b*, crown 76' is then deflected upward against washer 91. However, the deflections of crown 76' will not be sufficient to raise crown 76' into contact with transverse portion 97 or transverse portion 98 of washer 91, thereby minimizing the torsional load on nut 78' and consequent bending of tie rod 72' resulting therefrom. As a result, tie rod 72' will remain essentially in a vertical position.

To support the high pressures that washer 91 is subjected to during the operation of press assembly 30, washer 91 is not tapered about its entire bottom surface, but only along outwardly tapering transverse portions 97, 98. Thus, proper orientation of washer 91 on tie rod 72' is critical to the effectiveness of washer 91 in preventing bending of tie rod 72'. That is, transverse portions 97, 98 must be oriented so that deflections of crown 76' can occur without transmitting a substantial torque to washer 91.

Washer 91 is properly oriented when either transverse portion 97 or 98 faces the central vertical axis of press assembly 30 located between tie rods 72'. Alternatively stated, washer 91 is properly oriented when parallel sides 95 of flat central portion 93 are substantially perpendicular to the line from the center of its respective tie rod 72' to the central vertical axis of press assembly 30 in the plane of the outward surface of crown 76'.

Figure 10:
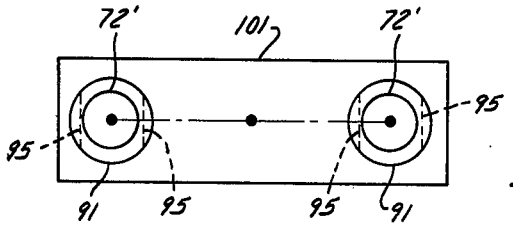
FIGS. 10, 11 and 12 are top plan views depicting the correct positioning of the washer of FIG. 9*c*, when employed in three embodiments of the present invention.
Figure 11:
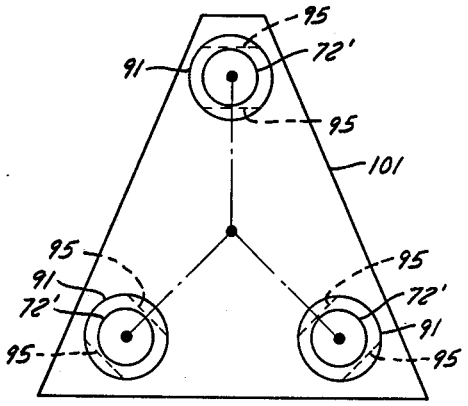
Figure 12:
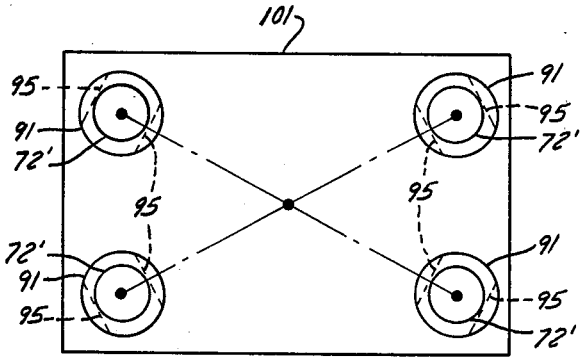

As seen in FIG. 10, the press assembly has a crown 101 supported by two tie rods 72'. A washer 91 is mounted on each tie rod 72' on its flat central bottom portion which has straight, parallel sides 95 positioned substantially perpendicular to the line in the plane of the outward surface of crown 101 from the center of the tie rod 72' to the central vertical axis of the press assembly. Similarly, the press assembly of FIG. 11 employes three tie rods 72' and washers 91 and the press assembly of FIG. 12 employs four tie rods and washers. As in the press assembly of FIG. 10, washers 91 in FIGS. 11 and 12 are mounted on their respective tie rods 72' on their flat central bottom portions with their straight, parallel sides 95 positioned substantially perpendicular to the line in the plane of the outward surface of crown 101 from the center of each tie rod 72' to the central vertical axis of the press assembly.

While washer 91 has been described and illustrated with respect to crown 76', it will be readily apparent to those skilled in the art that washer 91 can likewise be advantageously employed on the ends of the tie rods extending from the bed or lower resistance member 38 of the press assembly.

From a reading of the detailed description, it is evident that objects as set forth have been attained. A simple, but novel structure for a press assembly, particularly adapted for high pressure applications, has provided for the use of the prestressed tie rods as guides for the moving platen. Additionally, associated compressive members offset from the center line of the tie rods also function as part of the safety enclosure about the entire press structure. Thus, these and other variations and/or modifications within the scope of the appended claims will now be apparent to those skilled in the art.

I claim:

1. An assembly for high pressure compacting comprising:

(a) a frame structure including, (1) an upper resistance member having a plurality of vertical passages therethrough spaced a predetermined horizontal distance apart, (2) a lower resistance member vertically spaced below said upper resistance member and having a plurality of vertical passages therethrough spaced a predetermined horizontal distance apart, each said passage in said lower resistance member vertically aligned with a said passage in said upper resistance member, (3) a plurality of vertically disposed tie rods, each extending through a said passage in said upper resistance member and an aligned said passage in said lower resistance member and under a predetermined stress in tension, the diameter of each said tie rod being substantially equal to the diameter of the respective upper or lower passage through which it extends, and the ends of each said tie rod having external threads about the circumference thereof, (4) a plurality of washers, one of said washers mounted on each end of each said tie rod, each said washer having a flat outward surface with a diameter greater than the diameter of the respective said passage through said upper or lower resistance member which the tie rod on which said washer is mounted extends, a bore the diameter of which is substantially identical to the diameter of said tie rod it is mounted on, and an inward surface providing a flat central portion with straight, parallel side lines and a pair of outwardly tapered transverse portions, the width of said flat central portion being greater than the diameter of said respective passage, each said washer mounted on said tie rod with said flat central portion in contact with the outward surface of said respective upper or lower resistance member, and said parallel side lines of said flat central portion substantially perpendicular to the line from the center of the respective said tie rod to the central vertical axis of said assembly between said plurality of tie rods in the plane of said outward surface of the respective said resistance member in contact with it, (5) a plurality of vertical compression members, each spaced from one of said tie rods in a direction away from the outer facing surface thereof and having its upper surface in contact with the inward surface of said upper resistance member and its lower surface in contact with the inward surface of said lower resistance member under a predetermined compressive load, (6) a plurality of nuts, each of said nuts rotatably affixed to one end of one said tie rod with the inward surface of said nut in contact with the outward surface of said one of said washers mounted on said end of its respective tie rod, and each said nut having a bore therethrough with internal threads therein complementary to said external threads on said end of its respective tie rod; whereby said nuts, washers, compression members and tie rods cooperate to secure said upper and lower resistance members in said spaced apart relationship;

(b) a force means including a movable platen located on said central vertical axis and guided on the inner facing surface of said tie rods; and (c) moving means connected to one of said upper and lower resistance members for vertically moving said platen.

2. The assembly of claim 1 in which said frame structure is enclosed by an enclosure, said compression members forming part of said enclosure.

* * * * *